US006685027B2

(12) United States Patent
Yap

(10) Patent No.: US 6,685,027 B2
(45) Date of Patent: Feb. 3, 2004

(54) METHOD OF CONCENTRATING PHOSPHATES FROM THEIR ORES

(75) Inventor: Seng Yap, Lakeland, FL (US)

(73) Assignee: Arr-Maz Products, LP, Winter Haven, FL (US)

( * ) Notice: Subject to any disclaimer, the term of this patent is extended or adjusted under 35 U.S.C. 154(b) by 377 days.

(21) Appl. No.: 09/925,787

(22) Filed: Aug. 9, 2001

(65) Prior Publication Data

US 2003/0042177 A1 Mar. 6, 2003

(51) Int. Cl.[7] ..... B03D 1/02; B03D 1/10; B03D 103/06

(52) U.S. Cl. ..... 209/166

(58) Field of Search ..... 209/166, 167

(56) References Cited

U.S. PATENT DOCUMENTS

| | | | | |
|---|---|---|---|---|
| 2,105,807 | A | | 1/1938 | Crago |
| 2,288,237 | A | | 6/1942 | Greene |
| 2,293,640 | A | | 8/1942 | Crago |
| 2,312,414 | A | | 3/1943 | Jayne Jr. et al. |
| 2,327,408 | A | | 8/1943 | Ellis |
| 2,461,813 | A | | 2/1949 | Duke |
| 2,461,817 | A | | 2/1949 | Greene et al. |
| 2,599,530 | A | | 6/1952 | Hodges |
| 2,614,692 | A | | 10/1952 | Lawver |
| 2,661,842 | A | | 12/1953 | Duke et al. |
| 2,676,705 | A | | 4/1954 | Duke et al. |
| 2,682,337 | A | | 6/1954 | Hodges et al. |
| 2,706,557 | A | | 4/1955 | Houston et al. |
| 2,706,558 | A | | 4/1955 | Houston et al. |
| 2,724,501 | A | | 11/1955 | Hollingsworth et al. |
| 2,967,615 | A | * | 1/1961 | Goin |
| 4,069,144 | A | | 1/1978 | Johnson et al. |
| 4,289,612 | A | * | 9/1981 | Schrieber |
| 4,324,653 | A | | 4/1982 | Henchiri et al. |
| 4,372,843 | A | | 2/1983 | Lawver et al. |
| 4,436,616 | A | | 3/1984 | Dufour et al. |
| 4,486,301 | A | | 12/1984 | Hsieh et al. |
| 4,565,625 | A | | 1/1986 | Hsieh et al. |
| 4,648,966 | A | | 3/1987 | Hsieh |

* cited by examiner

*Primary Examiner*—Thomas M. Lithgow
(74) *Attorney, Agent, or Firm*—Dennis G. LaPointe; Mason Law, P.A.

(57) ABSTRACT

The present invention relates to a phosphate ore beneficiation process, which includes a method to float inadequately de-oiled phosphate particles prior to silica flotation. It is emphasized that this abstract is being provided to comply with the rule requiring an abstract that will allow examiners and searchers to quickly ascertain the subject matter of the technical disclosures. It is submitted with the understanding that it will not be used to interpret or limit the scope or meaning of the claims, as promised by the Patent Office's Rule 1.72(b) for abstracts.

11 Claims, 3 Drawing Sheets

METHOD OF CONCENTRATING PHOSPHATES FROM THEIR ORES

The present invention relates to a phosphate ore flotation process. The invention modifies the commonly used "double float" process. In the double float process, the first float is to reject most of the silica by floating the phosphate, producing a rougher phosphate concentrate, and the second float is to remove most of the remaining silica in the rougher concentrate by floating the silica. To prevent the phosphate from floating with the silica, the rougher concentrate is scrubbed with dilute acid prior to the second float. This process is referred to as "de-oiling". The present invention includes a method to float inadequately de-oiled phosphate particles prior to silica flotation, using a cationic collector.

The invention comprises the features that will be exemplified in the description hereinafter set forth, and the scope of the invention will be indicated in the claims. In the drawing illustrating an embodiment of the present invention:

Figure 2:
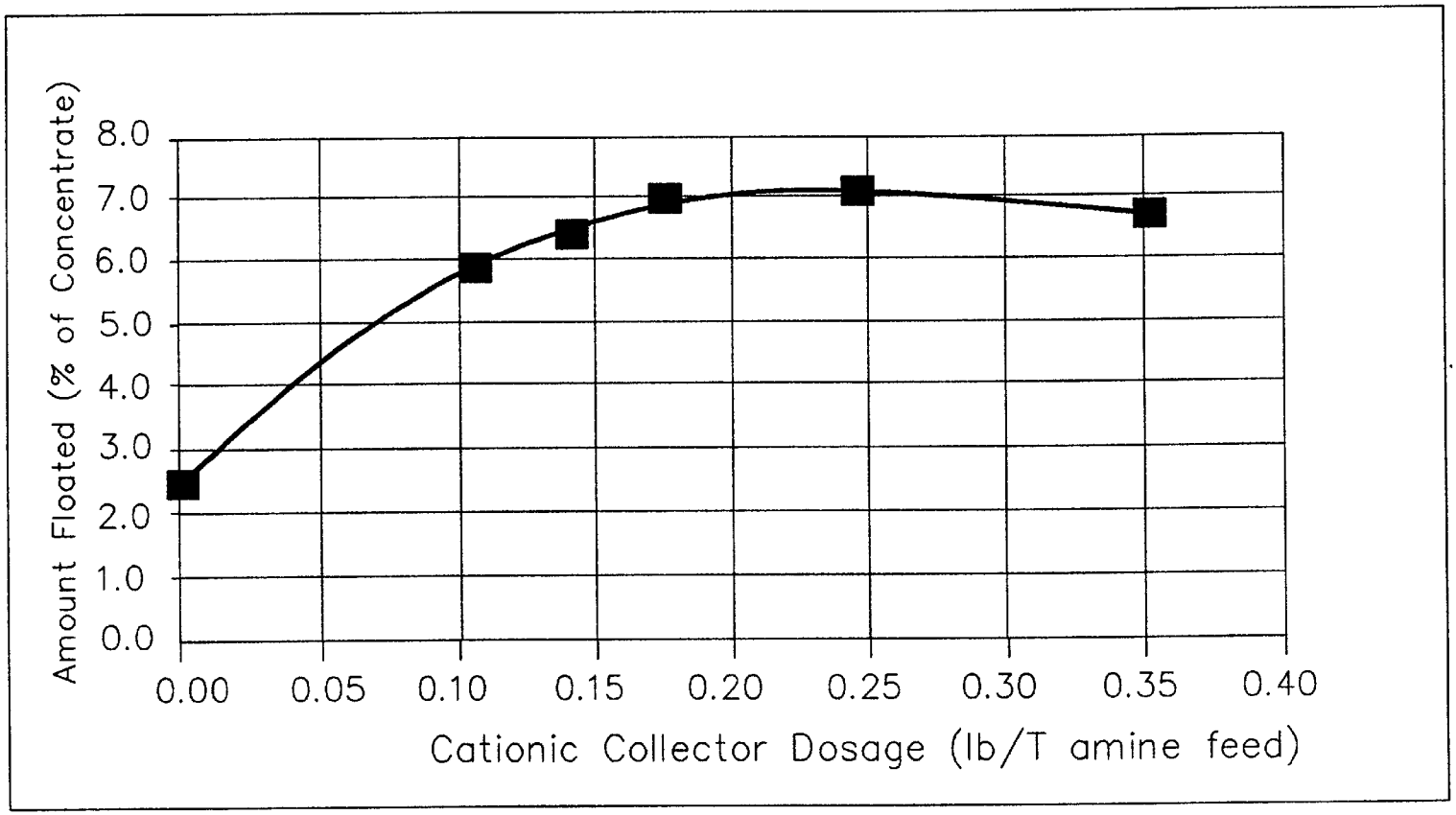
FIG. 2 is an example illustrating the relationship between cationic collector dosage and the amount floated.
Figure 3:
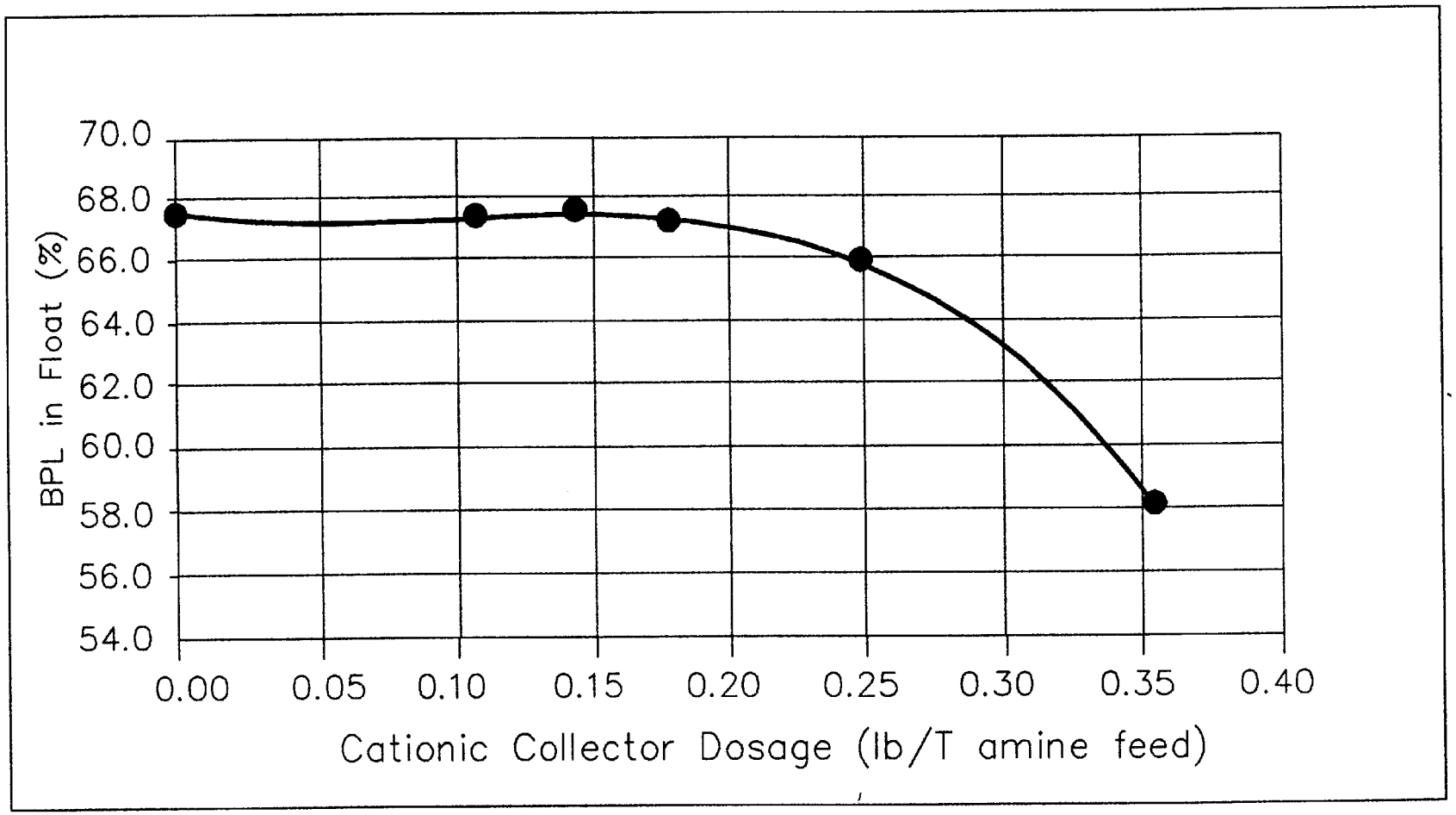
FIG. 3 is an example illustrating the relationship between cationic collector dosage and float grade.

From FIGS. 2 and 3, the cationic collector dosage needed to obtain optimum or desired recovery and concentrate grade can be determined.

Figure 1:
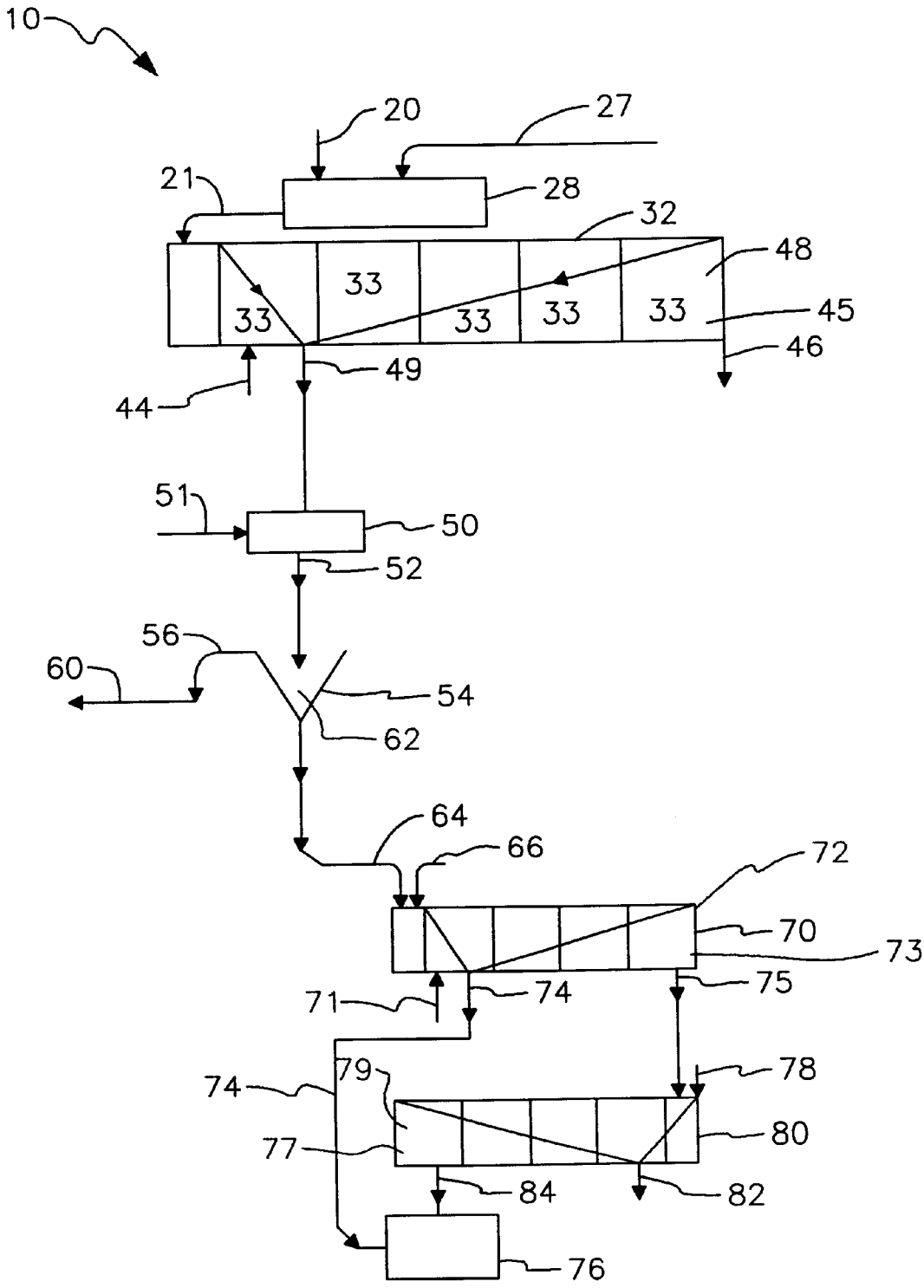
FIG. 1 is a schematic process flowsheet of the present invention; the inadequately de-oiled phosphate is floated in flotation device 70.

Referring now to the embodiment shown in FIG. 1, the phosphate flotation method of the present invention is shown and denoted generally as 10.

A flotation feed, constituting a phosphate ore rock slurry of −16 to +150 mesh size phosphate rock particles which is obtained from a desliming circuit of a phosphate beneficiation process (not shown), is introduced into conditioning chamber 28 via line 20. A pH modifier and anionic reagents (collectors) such as a fatty acid soap and fuel oil, are introduced into chamber 28 via line 27. The pH modifier may be comprised of caustic soda, soda ash or ammonia. Other pH modifiers known in the art for application to phosphate rock slurries may also be used. Petroleum sulfonates and other surfactants known in the art plus additional water may also be introduced into chamber 28.

The slurry containing hydrophobic phosphate rock particles is removed from chamber 28 and introduced into a first froth flotation device 32 via line 21 under conditions sufficient to float the hydrophobic phosphate particles to the top of the cells 33 as air is bubbled into the cells. The froth (rougher phosphate concentrate) 48 are removed from the upper part of device 32 via line 49. The hydrophillic material 45, constituting mostly silica/sand particles remain in the water and sink to the lower part of flotation device 32 and removed from device 32 via line 46 for disposal by means known in the art (not shown). The flotation device may comprise one or more cells 33 of conventional types where air is introduced into device 32 by means of line 44.

In the first froth flotation circuit (rougher flotation circuit), the silica content is reduced from 50–80 percent to 15–30 percent. The phosphate ore is preconditioned with, for example, a fatty acid soap, which is preferentially adsorbed by the phosphate particles, causing the phosphate particles to become hydrophobic. When the hydrophobic phosphate particles are introduced into the flotation device the phosphate particles attach to the air bubbles and float. Most of the silica particles remain in the water and sink. The floated phosphate ore (rougher phosphate concentrate) must be freed of collector before being fed to the amine circuit to float most of the remaining silica. To do this, the rougher phosphate concentrate is scrubbed with preferably a dilute sulfuric acid ($H_2SO_4$) at a pH of about 2.5 to about 4.0, followed by rinsing with water. This process is referred to as de-oiling.

The de-oiling process is very critical to phosphate recovery. Inadequate de-oiling ultimately causes phosphate loss unless proper steps are taken to reduce this loss. Inadequate de-oiling is usually a result of insufficient scrubbing and/or the use of an insufficient amount of sulfuric acid. One way to overcome this problem is to simply add more sulfuric acid. The addition of more sulfuric acid, however, not only increases cost, it may dissolve the phosphate and produce gypsum with the subsequent loss of the dissolved phosphate to the V box overflow, as more fully described herein below. Accordingly, heretofore sulfuric acid usage has been constantly monitored to obtain adequate de-oiling at minimum usage.

This monitoring is typically conducted by a plant operator's visual observation of the flotation of phosphate in the V-box or in the amine circuit. Generally, if no flotation of phosphate is visible an attempt is made to reduce the sulfuric acid usage. Alternatively, when the flotation of phosphate is visible sulfuric acid usage is increased. When poor de-oiling occurs several minutes lapse between the initiation of corrective action by the operator and the process reaching steady state. In the mean time, phosphate floats and is lost to the amine tailings, which can significantly reduce phosphate recovery.

Maintaining a proper balance between optimum de-oiling and minimum sulfuric acid usage is a difficult task to achieve because the required amounts of sulfuric acid vary depending upon the chemical and physical nature of the phosphate rock. In addition, these properties may change from one deposit to another. Further, the required amounts of sulfuric acid also depend upon numerous other factors including, but not limited to, the amount of carbonate impurities present, the composition of the fatty acids used, the composition of the fuel oils used, the pH in the conditioner, feed rates and residence time in the scrubber.

As shown in FIG. 1, the rougher phosphate concentrate 48 is passed to de-oiling tank 50 under conditions sufficient to produce a de-oiled phosphate concentrate. A mineral acid such as sulfuric acid is introduced into scrubber tank 50 via line 51.

The mixture of acid and rougher phosphate concentrate, as a slurry, is removed from tank 50 via line 52 and sent into a separator vessel 54, which may be one or more V-boxes, preferably three V-boxes, although other type vessels may also be used. Rinse water, via means not shown, is also introduced into vessel 54.

After rinsing and separation, the rinse water containing the mineral acid is removed via line 56 for disposal 60 by means not shown.

The rinsed rougher phosphate concentrate (amine feed) 62, is removed from the bottom of the last V-box via line 64 and introduced into a first cationic flotation device (second froth flotation device) 70 under conditions sufficient to further remove any inadequately de-oiled phosphate particles from the amine feed 62. Cationic collector is added into second flotation device 70 via line 66 in the form of an aqueous dispersion of from about 0.01 to about 0.5 pounds of cationic collector per ton of amine feed 62. The pH of the slurry in device 70 is typically about 6.0 but may be in the range of about 5.0 to about 7.0. Air, by means not shown, is also introduced into device 70 via line 71.

The cationic collector, when used in very small quantity, is preferentially adsorbed by phosphate particles which are inadequately de-oiled. The adsorption onto silica occurs at higher collector dosage. Therefore, selective flotation of the inadequately de-oiled phosphate particles can be obtained by using proper dosage of the cationic collector. The floated phosphate 72 are recovered from device 70 via line 74 and sent to phosphate concentrate storage location or area 76. The slurry 73, denuded or cleaned of inadequately de-oiled phosphate particles is discharged from the bottom of flotation device 70 and reports to flotation device 80 via line 75. Cationic/amine collector or reagent, typically from about 0.1 to about 2.0 pounds per ton of the underflow product from device 70 that reports to device 80, is introduced into device 80 via line 78 under conditions sufficient to produce an overflow product of siliceous material having very little phosphate particles.

The cationic collector, which is positively charged, is preferentially adsorbed by the negatively charged silica, causing the surface of the silica particles to become hydrophobic and to attach to air bubbles and float in flotation device 80. The froth is removed from the upper section of flotation device 80 as part of the froth 79 and are transported via line 82 to sand disposal areas (not shown). The phosphate particles 77 remain in the water and sink. The phosphate 77, is transported from flotation device 80 via line 84 for recovery to final phosphate storage bin 76.

Various cationic/amine collectors known in the art can be used in the present invention. For example, cationic collectors useful in the present invention include long chain amines, amine salts including amine acetates and long chain quaternary ammonium salts. Generally, the long chain amines useful in the present invention are derived from tall oil fatty acids, tallow fatty acids, vegetable fatty acids, and long chain alcohols. More specifically, the long chain amines are preferably fatty amido amines, tallow amines, ether amines or their acetates. Further, the amines useful in the present invention may be polyfunctional.

An effective amount of a frothing agent may be added to the cationic collector or to flotation device 70 and flotation device 80. Frothing agents useful in the present invention are known in the art, including but not limited to, pine oils, $C_4$ to $C_8$ alcohols, polyglycols and glycol ethers. Generally the frothing agent used is less than the amount of the cationic/amine collector. Typically, the frothing agent used is an amount of 0–40 percent of the amine collector.

The flotation devices are known in the art, for example, Denver flotation devices, Wemco flotation devices and Autokumpu flotation devices. Alternatively, column flotation devices are also useful in the present invention. Dual extraction columns from Beneficiation Technologies, Inc., is one example. V-boxes or other types of boxes sparged with air are also useful in the practice of the present invention.

As illustrated above, the present invention provides a method of concentrating phosphate minerals from their ores which comprises: (a) subjecting the ore as an aqueous pulp to a first froth flotation treatment in the presence of an anionic reagent under conditions sufficient to produce a first froth overflow product of rougher phosphate concentrate and a first underflow of siliceous product; (b) subjecting the first froth overflow product of rougher phosphate concentrate to de-oiling treatment with mineral acid under conditions sufficient to produce a de-oiled phosphate concentrate; (c) subjecting the de-oiled phosphate concentrate to a second froth flotation treatment in the presence of cationic collectors under conditions sufficient to produce a second froth overflow product of a first final phosphate concentrate and a second underflow product of phosphate particles containing siliceous material; (d) subjecting the second underflow product to a third froth flotation treatment in the presence of cationic reagents under conditions sufficient to thereby produce a third froth overflow product of siliceous material having less phosphate particles and a third underflow product comprising phosphate particles as a second final phosphate concentrate; and (e) recovering the first and second final phosphate concentrates.

The present invention is particularly useful for phosphate ore that is difficult to de-oil. It is also useful when the carbonate content of the phosphate rock is high, because it is often difficult to maintain the acidic conditions necessary for complete de-oiling of the surface of the phosphate particles. High carbonate content requires a large excess of sulfuric acid because the acid is consumed by the carbonates. The increased amount of sulfuric acid used in the de-oiling process increases the possibility of $P_2O_5$ loss due to leaching of phosphate rock. This invention prevents the phosphate loss due to phosphate rock leaching. Furthermore, the present invention can be practiced without high capital investment.

The method of the present invention causes the inadequately de-oiled phosphate particles to float. Specifically, the inadequately de-oiled phosphate particles are recovered as concentrate prior to silica flotation. Accordingly, the loss of phosphate to the amine tailings is reduced. In addition, the de-oiling step becomes less critical because de-oiling does not have to be complete. Since de-oiling does not need to be complete the de-oiling process becomes easier. Further, the amount of sulfuric acid used during the process is reduced, as well as, the amount of soda ash used to neutralize the sulfuric acid. If additional flotation devices are not available, the additional in series cationic/amine flotation circuit of the present invention can be conducted in the last V-box 54 by installing aeration systems as is within the skill of the art.

In fact, V-boxes or any other type of boxes sparged with air are also useful in the practice of the present invention. For plants that have more than four pockets (cells) for the amine flotation circuit, the flotation of the inadequately de-oiled phosphate can be conducted in the first two pockets, and additional cationic collector can be added to the third pocket (cell) to float the silica.

EXAMPLE

The following example is presented to illustrate the invention, which is not intended to be in any way limited thereto, since numerous modifications and variations therein will be apparent to one skilled in the art. Actual experimental data was obtained as follows:

The results of treating the amine feed from various phosphate beneficiation plants are shown in Table 1. Specifically, these amine feeds were generated under regular de-oiling conditions. Subsequently, these amine feeds were subjected to an additional cationic flotation step in accordance with the present invention. The amount of phosphate concentrate collected from flotation of these amine feeds with the cationic/amine collector (0.2 lbs./ton feed) is shown in Table 1.

TABLE 1

| Feed Source | Amount of Concentrate (BPL 65–66%) % of Final Concentrate Weight |
|---|---|
| Plant A | Run 1 = 3.7%; Run 2 = 3.2%; Run 3 = 4.4%; Run 4 = 4.1% |
| Plant B | Run 1 = 1.5% |
| Plant C | Run 1 = 1.5% |

The results shown in Table 1 clearly show the benefits of using an additional cationic flotation step to remove the inadequately de-oiled phosphate particles from the amine feed. Additional 1.5–4.4% of phosphate concentrate which would have been lost to the amine tailings is recovered.

Examples of the amount of cationic collector needed to obtain a desired recovery and grade of phosphate floated is illustrated in FIGS. 2 and 3. FIG. 2 illustrates the relationship between cationic collector dosage and amount floated, and FIG. 3 illustrates the relationship between cationic collector dosage and float grade. FIG. 3 shows that increase silica flotation occurs when cationic collector dosage exceeds 0.2 lbs. per ton of amine feed. The actual amounts of collector needed depends on the feed, the molecular structure and composition of the collector, slime content of the water, etc.

This invention is clearly new and useful. Moreover, it was not obvious to those of ordinary skill in this art at the time it was made. Since certain changes may be made in the foregoing description without departing from the scope of the invention, it is intended that all matters contained in the foregoing description shall be interpreted as illustrative and not in a limiting sense.

Further, it is understood that alternative embodiments from that depicted in FIG. 1 are useful in the present invention. Those skilled in the art recognize that other structures and features may be present in the beneficiation flow sheet of the present invention. For example, some beneficiation plants have distribution boxes at various positions in the flow sheet (not shown). Distribution boxes may be used for the addition of reagents.

It should be understood that the preceding is only a description of one embodiment of this invention and that numerous changes to the disclosed embodiment can be made in accordance with the disclosure herein without departing from the spirit or scope of the invention. The preceding description, therefore, is not meant to limit the scope of the invention. Rather, the scope of the invention is to be determined only by the appended claims and their equivalents.

It is also to be understood that the following claims are intended to cover all of the generic and specific features of the invention herein described and all statements of the scope of the invention which, as a matter of language, might be said to fall therebetween.

Now that the invention has been described,

What is claimed is:

1. A method of concentrating phosphate minerals from their ores comprising:

subjecting the ore as an aqueous pulp to a first froth flotation treatment in the presence of an anionic collector under conditions sufficient to produce a first froth overflow product of rougher phosphate concentrate and a first underflow product of siliceous material;

subjecting the first froth overflow product of rougher phosphate concentrate to de-oiling treatment with mineral acid under conditions sufficient to produce a de-oiled phosphate concentrate;

subjecting the de-oiled phosphate concentrate to a second froth flotation treatment in the presence of cationic collectors under conditions sufficient to produce a second froth overflow product of a first final phosphate concentrate and a second underflow product of phosphate particles containing siliceous material;

subjecting the second underflow product to a third froth flotation treatment in the presence of cationic collectors under conditions sufficient to produce a third froth overflow product of siliceous material having less phosphate particles and a third underflow product of a second final phosphate concentrate; and recovering the first and second final phosphate concentrate.

2. The method according to claim 1, wherein the cationic collectors are selected from the group consisting of long chain amines, amine salts, long chain quaternary ammonium salt, and mixtures thereof.

3. The method according to claim 1, where a frothing agent is added to the second froth flotation treatment.

4. The method according to claim 3, wherein the frothing agent is selected from the group consisting of pine oils, $c_4$–$c_8$ alcohols, polyglycols, and glycol ethers.

5. The method according to claim 1, wherein the conditions sufficient to produce the first final phosphate concentrate includes an amount of cationic collector of from about 0.01 to about 0.5 pounds of collector per ton of the de-oiled phosphate concentrate.

6. The method according to claim 1, wherein the conditions sufficient to produce the second final phosphate concentrate include an amount of cationic collector of from about 0.1 to about 2 pounds of the collector per ton of the second underflow product of phosphate particles containing siliceous material.

7. The method according to claim 1, wherein the conditions sufficient to produce the first final phosphate concentrate include the presence of a frothing agent.

8. The method according to claim 7, wherein the frothing agent is selected from the group consisting of pine oils, $c_4$–$c_8$ alcohols, polyglycols, and glycol ethers.

9. The method according to claim 1, wherein the conditions sufficient to produce the second final phosphate concentrate include the presence of a frothing agent.

10. The method according to claim 9, wherein the frothing agent is selected from the group consisting of pine oils, $c_4$–$c_8$ alcohols, polyglycols, and glycol ethers.

11. The method according to claim 1, wherein the mineral acid is sulfuric acid.

* * * * *